US007806762B2

(12) United States Patent
Padgett

(10) Patent No.: US 7,806,762 B2
(45) Date of Patent: Oct. 5, 2010

(54) BINGO PRIZE MAPPING SYSTEM WITH PRIZE PROMOTION

(75) Inventor: John E. Padgett, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 520 days.

(21) Appl. No.: 11/076,257

(22) Filed: Mar. 9, 2005

(65) Prior Publication Data

US 2006/0205478 A1 Sep. 14, 2006

(51) Int. Cl.
*A63F 9/24* (2006.01)

(52) U.S. Cl. ..... 463/19

(58) Field of Classification Search ..... 463/19, 463/16–18, 20, 21
See application file for complete search history.

(56) References Cited

U.S. PATENT DOCUMENTS

| | | | | |
|---|---|---|---|---|
| 4,858,932 | A | 8/1989 | Keane | |
| 4,991,848 | A | 2/1991 | Greenwood et al. | |
| 5,169,147 | A | 12/1992 | Hamano | |
| 5,209,479 | A | 5/1993 | Nagao et al. | |
| 5,275,400 | A | 1/1994 | Weingardt et al. | |
| 5,401,023 | A | 3/1995 | Wood | |
| 5,423,539 | A | 6/1995 | Nagao | |
| 5,423,541 | A | 6/1995 | Nicastro et al. | |
| 5,511,784 | A | 4/1996 | Furry et al. | |
| 5,639,088 | A | 6/1997 | Schneider et al. | |
| 6,003,867 | A | 12/1999 | Rodesch et al. | |
| 6,068,552 | A | 5/2000 | Walker et al. | |
| 6,113,492 | A | 9/2000 | Walker et al. | |
| 6,213,877 | B1 | 4/2001 | Walker et al. | |
| 6,368,214 | B1 | 4/2002 | Luciano | |
| 6,554,705 | B1 * | 4/2003 | Cumbers | 463/29 |
| 6,569,017 | B2 | 5/2003 | Enzminger et al. | |
| 6,581,935 | B1 | 6/2003 | Odom | |
| 6,884,167 | B2 * | 4/2005 | Walker et al. | 463/20 |
| 2003/0069074 | A1 * | 4/2003 | Jackson | 463/43 |
| 2003/0195032 | A1 | 10/2003 | Enzminger et al. | |
| 2004/0048647 | A1 * | 3/2004 | Lind et al. | 463/19 |

(Continued)

FOREIGN PATENT DOCUMENTS

EP 0984408 A2 8/1999

OTHER PUBLICATIONS

Marshall Fey, "Slot Machines A Pictorial History of the First 100 Years", 5th ed, p. 76, Draw Poker 1901.*

(Continued)

*Primary Examiner*—Peter DungBa Vo
*Assistant Examiner*—Omkar Deodhar
(74) *Attorney, Agent, or Firm*—Russell D. Culbertson; Nathan H. Calvert; J P Cody

(57) ABSTRACT

A promotion index value is produced for a player in a bingo game. This promotion index value is then used in assigning a prize to the player for their participation in the bingo game. In one embodiment, a particular bingo pattern achieved in a bingo game is associated with an initial index value. The promotion index value is then produced and added to the initial index value to produce a final index value. This final index value is then used to look up an associated bingo game prize which is assigned to the player.

17 Claims, 5 Drawing Sheets

U.S. PATENT DOCUMENTS

| | | | |
|---|---|---|---|
| 2004/0152499 | A1 | 8/2004 | Lind et al. |
| 2004/0152503 | A1 | 8/2004 | Lind et al. |
| 2005/0043079 | A1 | 2/2005 | Huang |

OTHER PUBLICATIONS

Fey, Slot Machines A Pictorial History of the First 100 Years, 1997, pp. 243-244.

How They Work. www.wizardofodds.com. Jul. 15, 2001.
Slot Machine Appendix. www.wizardofodds.com. Sep. 19, 2001.
Slot Machine Appendix 4. www.wizardofodds.com. Sep. 19, 2001.
Slot Machine Appendix 5. www.wizardofodds.com. Oct. 25, 2002.
International Search Report for PCT/US2006/06415 dated Sep. 24, 2007 (2 Pages).
Written Opinion of the International Search Authority (PCT Rule 43bis. 1) for PCT/US2006/06415 dated Sep. 24, 2007 (4 Pages).

* cited by examiner

BINGO PRIZE MAPPING SYSTEM WITH PRIZE PROMOTION

TECHNICAL FIELD OF THE INVENTION

This invention relates to electronic bingo gaming systems. More particularly, the invention is directed to apparatus, methods, and program products for modifying payouts in a bingo game.

BACKGROUND OF THE INVENTION

The game referred to generally as "bingo" is played with predetermined bingo cards that include a number of designations randomly arranged in a grid, matrix, or other layout of spots or locations. The bingo cards may be physically printed on paper or another suitable material, or may be represented by a data structure which defines a bingo card representation having the various card locations and designations associated with the locations. In the traditional bingo game sequence, a number of the bingo cards are first sold for a particular bingo game. After the sale of bingo cards is closed for a given game, designations are randomly selected from a pool of available designations and matched to the designations of each bingo card that is in play in the bingo game. This matching of bingo designations randomly selected for a game and bingo designations associated with a card in play in the game is commonly referred to as daubing the card. Daubing a card results in an arrangement of matched spots or card locations for the card.

In traditional bingo games, daubing was done manually by the player holding the bingo card, and then by a game administrator to verify a win in the game. More recent bingo gaming systems automatically check for winning patterns on a bingo card as designations are randomly selected for a game. Regardless of how the bingo cards in play in a game are daubed, the first card which is daubed to achieve a predefined game ending pattern is considered a winning card for the game and a prize may be awarded to the player holding the winning card. Other prizes may be awarded for bingo cards achieving other patterns of daubed locations in the course of the bingo game.

The various patterns that may be achieved in a bingo game may each be mapped to a particular prize. U.S. Pat. No. 6,569,017, issued May 27, 2003, filed Apr. 18, 2001, entitled "Method for Assigning Prizes in Bingo-Type Games," and U.S. patent publication No. 2004-0048647, entitled "Prize Assignment Method and Program Product for Bingo-Type Games" each describe systems for mapping bingo patterns to prizes that may be awarded in a bingo game.

One problem with bingo games is that the probability of winning or losing with a particular card is always determined by a fixed set of constraints. These constraints include the number of designations available in the pool of designations, the predetermined pattern or patterns to be matched, and the number of locations on the bingo card. For a given set of constraints, the probabilities of winning and losing are generally fixed. Although it is possible to vary these bingo probabilities by varying these constraints, varying the constraints may be cumbersome. Also, even varying the constraints for the bingo game only has a limited effect on the resulting bingo probabilities of winning a prize in a particular bingo game.

SUMMARY OF THE INVENTION

The present invention provides methods, apparatus, and program products for providing greater flexibility in assigning prizes in bingo games. The invention includes producing a promotion index value that is not associated with a player's result in a bingo game. This promotion index value is then used in assigning a prize to the player for their participation in the bingo game. By assigning prizes in the bingo game based at least in part on the promotion index value, the present system allows for greater flexibility in payout tables for the bingo game and for greater flexibility in awarding prizes.

In one preferred method according to the invention, a particular bingo pattern achieved in a bingo game may be associated with an initial index value. The promotion index value produced according to the invention is then employed by adding that value to the initial index value to produce a final index value. This final index value is then used to look up an associated bingo game prize which is assigned to the player.

The invention may also encompass a program product that may be executed to provide the desired prize assigning flexibility. The program product may include a set of machine-readable instructions that when executed are configured to identify the promotion index value. The program product further includes instructions that are executed to then assign to the bingo game player a bingo game prize based at least in part on the promotion index value.

A preferred system according to the present invention includes a prize promotion controller and a prize assignment controller. The prize promotion controller receives an initial index value correlated to a bingo game result for a player and determines a promotion index value for the player. The prize assignment controller uses the promotion index value at least in part to identify a final prize value which is assigned to the player. The final prize value is assigned instead of, or in addition to, a prize associated with the initial index value. A system according to the present invention may also include a player station through which a player initiates a bingo game play request which is processed by a suitable bingo game result controller to identify the bingo game result for the game play request.

These and other advantages and features of the invention will be apparent from the following description of the preferred embodiments, considered along with the accompanying drawings.

As used in this disclosure any sequence of designations that may be matched against bingo cards or bingo card representations in the present gaming system will be referred to as a "ball draw" regardless of how the sequence is actually generated. Under this definition, it will be appreciated that a ball draw may be produced by a random number generator, a pseudo random number generator, or any other suitable device or system, and not necessarily a physical ball draw device. Also, for purposes of convenience, the designation "bingo card" will be used to refer to both physical bingo cards and bingo card representations. Further, unless otherwise specified, the designation "bingo game" will be used herein to refer to any game in which a result is identified by matching a bingo card to a ball draw in any fashion, without regard to the sequence in which this matching (daubing) step is performed in relation to other steps in the game and without regard to how this matching/daubing is accomplished.

DESCRIPTION OF PREFERRED EMBODIMENTS

The following description of the present invention will be made in reference to a particular bingo gaming system disclosed fully in U.S. patent application Ser. No. 10/456,721 entitled "Method, System, and Program Product for Conducting Multiple Concurrent Bingo-Type Games," which is incorporated in this application by this reference. However, it should be noted that this particular bingo gaming system is used only as a convenient example and reference point for disclosing the features of the present invention. The present invention is by no means limited to use in the particular bingo gaming system disclosed in U.S. patent application Ser. No. 10/456,721. Rather, the invention may be used in connection with any bingo gaming system utilizing an electronic player station to present results to a bingo game participant.

Figure 1:
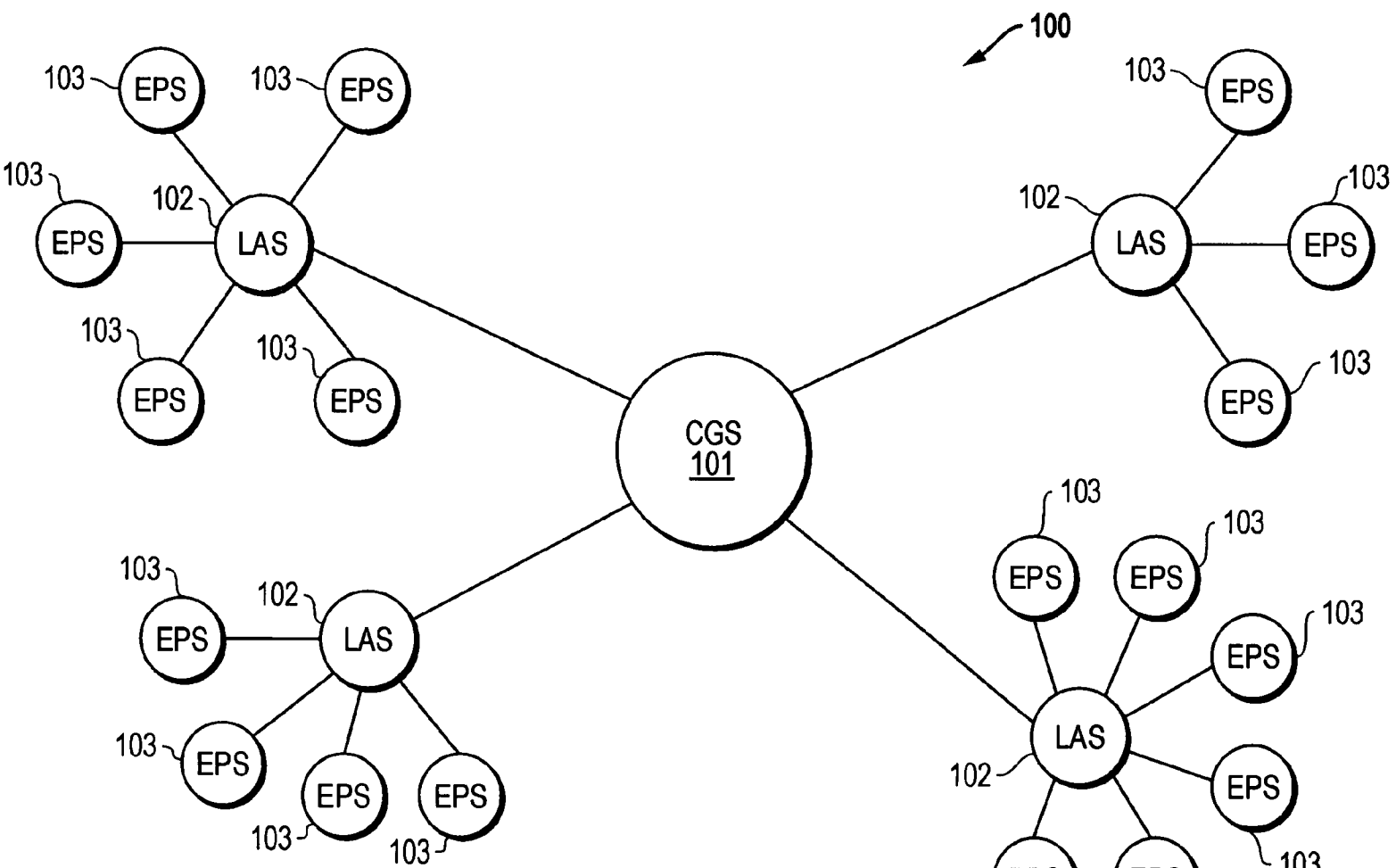
FIG. 1 is a high level diagrammatic representation of a bingo gaming system in which the present invention may be implemented.

Gaming system 100 shown in FIG. 1 includes a central game server (CGS) 101 that cooperates with a number of other components to enable players, preferably at many different remote gaming sites on a network, to participate in bingo games. The example system in FIG. 1 shows four different gaming sites or casinos, each gaming site having a local area server (LAS) 102 and a number of electronic player stations (EPSs) 103. In the normal operation of gaming system 100, a player at any EPS 103 in the system may participate in a given bingo game with players at any other of the EPSs 103 in the system.

CGS 101 may include one or more computer systems, each including one or more processors, nonvolatile memory, volatile memory, a user interface arrangement (for system operator access), and a network communications interface. Each LAS 102 included in system 100 may also include one or more computer systems each having one or more processors, nonvolatile memory, volatile memory, a user interface arrangement for system operator access, and a network communications interface. Each EPS 103 also preferably includes at least one processing device and a suitable network communication arrangement. Each EPS 103 also includes a player interface arrangement that allows a player to enter bingo games offered through gaming system 100 and display results in an exciting and attractive format. This player interface may include one or more player input devices, one or more displays or touch screen displays, a sound system, a convenient arrangement for dispensing winnings and allowing the player to make wagers, and perhaps other features such as alarms or special displays or alerting devices.

The details of CGS 101, LASs 102, and EPSs 103 shown in the example system 100 of FIG. 1 are not shown in that figure so as not to obscure the invention in unnecessary detail. Structural details relevant to the present invention will be discussed with reference to FIG. 2 below. However, it will be appreciated that each of the processing devices included in system 100 preferably operates under the control of operational program code to perform or direct the various functions provided by CGS 101, each LAS 102, and each EPS 103. Alternatively, the various functions performed by CGS 101, each LAS 102, and each EPS 103 may be performed through special purpose processing devices or circuits.

In operation, a player in system 100 shown in FIG. 1 will enter a game play request through an EPS 103. This game play request represents a request to participate in a bingo game conducted through system 100. Variations in how a game play request may be entered/submitted according to the present invention will be described below with reference to FIG. 3. Regardless of how a given game play request for a player is produced and submitted, the game play request will, at some point in system 100, be associated with a particular bingo card in the form of data that represents/defines the bingo card. This data representing/defining a bingo card may be referred to as a bingo card representation. The bingo card representation associated with a game play request is eventually matched with a ball draw for a bingo game to identify a bingo game result for the game play request. This bingo game result is correlated to an initial index value which in turn correlates to a prize value. As will be discussed in detail below, the present invention produces a final prize value that does not necessarily correspond to the prize value indicated by the result in the bingo game. Rather, the final prize value may be varied by application of a promotion index value.

The particular configuration of devices shown in FIG. 1 is shown only for purposes of example. A gaming system according to the present invention may omit some or all of the separate LASs 102 at the various gaming facilities so that the EPSs 103 communicate directly with CGS 101. Also, various regions or different gaming facilities may be divided up into separate systems each having a respective CGS such as CGS 101. In these situations the system could be configured such that a single EPS 103 may be serviced by any of the CGSs. Furthermore, a gaming system embodying the principles of the invention may include multiple CGSs rather that a single CGS 101 as shown in FIG. 1. Finally, it will be noted again that the gaming system shown in FIG. 1 is shown only for purposes of example in order to provide a convenient context to describe the present invention below. The present invention is by no means limited to use in bingo gaming system 100 shown in FIG. 1. Rather, the present invention may be applied to any bingo game, whether manual or electronic, and whether games are conducted in a traditional bingo sequence or conducted in some other sequence, such as where bingo cards are compared to a ball draw to identify results prior to assignment of the bingo cards to players.

Figure 2:
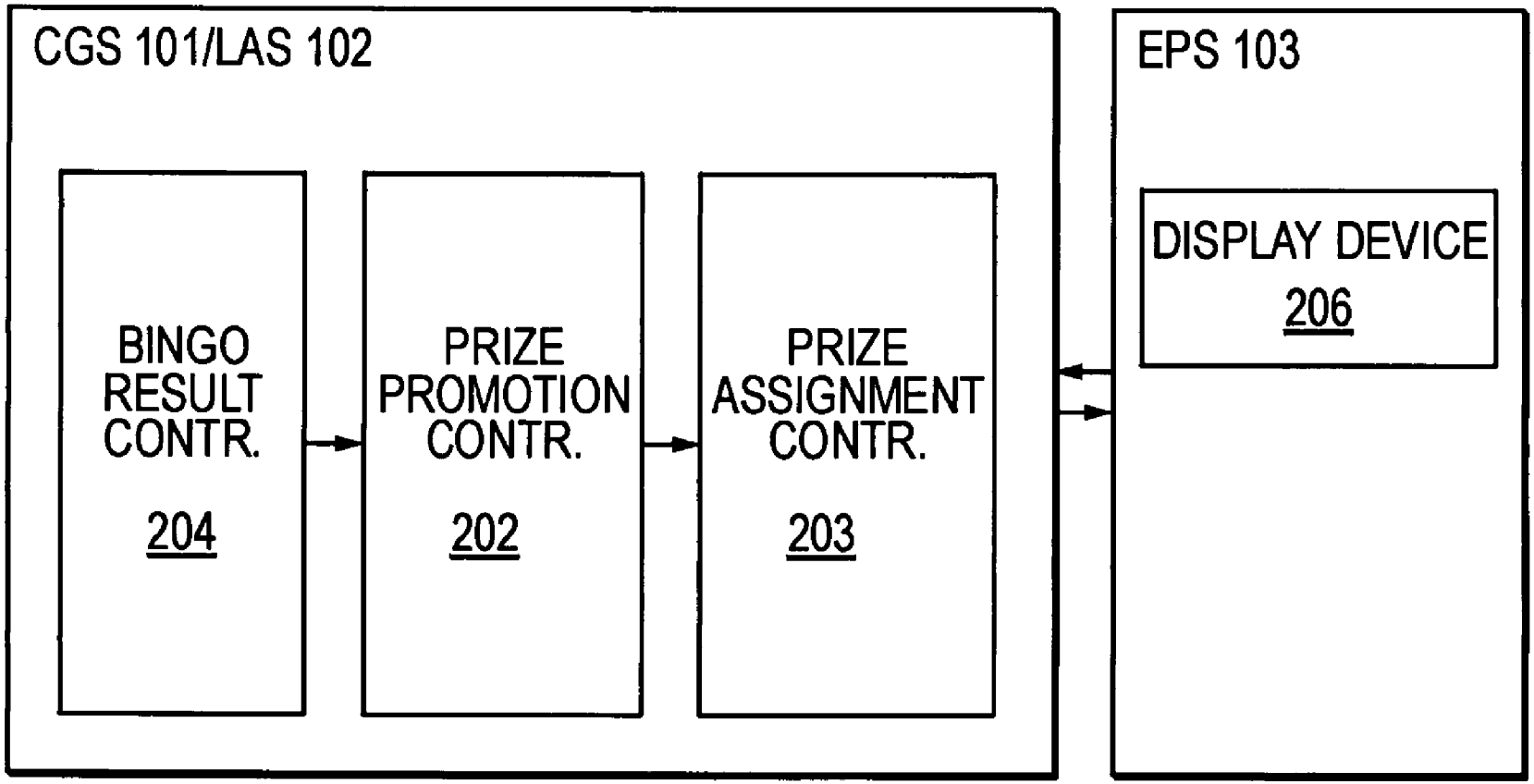
FIG. 2 is a diagrammatic representation of a system embodying the principles of the present invention.

FIG. 2 shows various components of the present invention as implemented in the gaming system 100 shown in FIG. 1. The present invention includes a prize promotion controller 202 and a prize assignment controller 203. Prize promotion controller 202 produces a promotion index value for a game play request submitted in the system. This promotion index value may be used in a number of different ways by prize assignment controller 203 to identify a final prize value for the game play request and assign that final prize value to the player submitting the game play request. According to the invention, the final prize value does not necessarily correspond to a prize value associated with the result the player obtains in the bingo game. Rather, the present invention employs the promotion index value in some manner to vary the prize actually assigned to the player from the prize that would have been assigned without application of the present invention. Variations in how the final prize value may be produced within the scope of the present invention will be described below with reference to the flow diagram of FIG. 3 and the examples illustrated in FIGS. 4 and 5.

The preferred form of the invention shown in FIG. 2 also includes a bingo game result controller 204. This bingo game result controller 204 comprises the component of system 100 (FIG. 1) that receives a game play request for a player and identifies the bingo game result for the game play request. In preferred forms of the present invention, bingo game result controller 204 also associates the identified bingo game result with an initial index value. The manner in which this initial index value may be applied to assign a prize value to the player according to the invention will also be described below with reference to FIGS. 3 through 5.

As indicated in FIG. 2, an EPS 103 is in communication with the system component or components that implement controllers 202, 203, and 204. The EPS 103 shown in FIG. 2 includes a display device 206 that is used to display results for a given bingo game play request to a player at the EPS. These results may be displayed in any number of different fashions within the scope of the present invention. In addition to displaying the prize value, display device 206 preferably displays the bingo game result in the form of some entertaining graphic representation that indicates the awarded prize. This entertaining graphic representation may be associated with bingo, or may be associated with an entirely different type of game, such as a reel-type (slot machine) game, a card game, or any other type of game.

It will be appreciated that the arrangement of controllers shown in FIG. 2 is shown only for purposes of example. Although FIG. 2 shows controllers 202, 203, and 204 all implemented at a common processing device or system (the CGS 101 or a LAS 102 as described in connection with FIG. 1), preferred forms of the invention may implement these controllers at separate processing devices. For example, bingo game result controller 204 may be implemented at a centralized device such as the CGS 101 in FIG. 1, while prize promotion controller 202 and prize assignment controller 203 may be implemented at a different component in system 100. In one preferred form of the invention, each LAS 102 implements a prize promotion controller 202 and prize assignment controller 203 for the EPSs 103 serviced by the respective LAS. In yet another preferred form of the invention each EPS 103 may implement its own prize promotion controller 202 and prize assignment controller 203. Yet other preferred forms of the invention may implement prize promotion control 202 and prize assignment controller 203 at different components and system 100. For example, each EPS 103 may implement its own respective prize assignment controller 203 and each LAS 102 implements a prize promotion controller for each EPS 103 serviced by the respective LAS.

Figure 3:
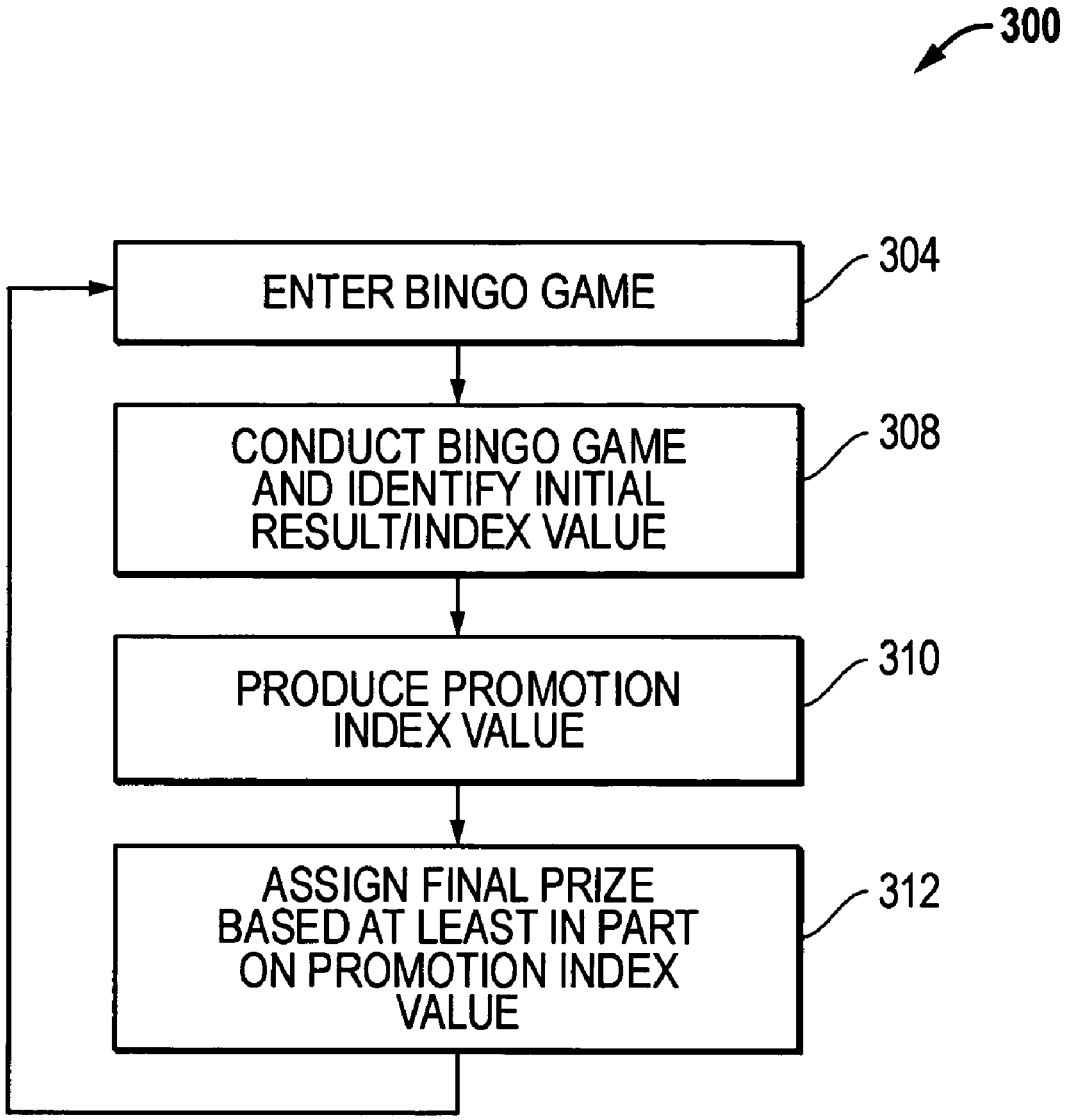
FIG. 3 is a flow diagram illustrating a gaming method embodying principles of the present invention.

FIG. 3 shows a process 300 that may be performed according to the present invention. As indicated a process block 304, a player first submits a game play request in a bingo game. A bingo game is then conducted as shown at process block 308 to identify a result for the game play request submitted at block 304, and to identify an initial index value corresponding to that result. The present invention also includes producing a promotion index value as shown that process block 310, and ultimately includes assigning a final prize to the player as shown at process block 312.

The present invention encompasses any arrangement of steps that may be used to submit a game play request as shown at process block 304. For example, a player may make an input at a player station (such as an EPS 103 shown in FIGS. 1 and 2) to select a bingo card for the particular play, make an input to select a wager, and then make an input to actually generate and transmit the game play request to the component in the system responsible for identifying the results of the bingo game, the CGS 101 or the local LAS 102. As another example, a player may merely be required to make a single input to make a game play request, and the bingo card and wager level may be set automatically in some fashion.

The step shown at blcok 308 in FIG. 3 is preferably performed by a bingo game result controller such as controller 204 shown in FIG. 2. The present invention is not limited to any particular process for conducting bingo games and identifying the bingo game result for a particular game play request. Generally, conducting a bingo game involves collecting two or more game play requests each associated with a respective bingo card, generating or obtaining a ball draw, and comparing the designations of the ball draw to the bingo cards to identify any predefined winning patterns of locations on each bingo card. The pattern of locations matched on a player's bingo card at the end of a bingo game determines the player's result for that bingo game.

It will be appreciated that the step of identifying results in a bingo game may be affected by the particular rules under which the bingo game is conducted. In some bingo systems, no player input is required after the player makes his or her original game play request. However, other bingo gaming rules may require a player to take one or more daubing or prize claiming actions to obtain the result associated with the player's game play request. The present invention encompasses all of the different types of bingo game implementations, without regard to the number and type of any player actions or inputs that are required to end the bingo game and/or receive the bingo results. For the purposes of this disclosure and the discussion associated with FIG. 3 it is assumed that any required player actions are taken to allow the system to proceed to identify the bingo game result as indicated at block 308.

In some preferred forms of the present invention, each pattern that is defined for a bingo game, that is, each potential bingo game result, correlates to one of a number of different index values. The index value correlated to the bingo game result identified at process blcok 308 in FIG. 3 is referred to in this disclosure as the initial index value for a given game play request. This initial index value may be used according to the invention together with other index values to produce a final prize that is assigned to the player for their participation in a bingo game.

The present gaming system does not simply use the initial index value identified for a given game play request, or a prize value associated with the player's bingo game result to assign a prize to the player. Rather, as shown at process block 310, the invention includes producing a promotion index value, and, as indicated at process block 312, this promotion index value is used in assigning a prize to the player who initiated the game play request at process block 304.

The steps of producing the promotion index value for a given game play request and then using the promotion index value to assign a final prize to a player may be accomplished in a number of different fashions within the scope of the present invention. In one preferred form of the invention which will be described in terms of several examples in FIG. 4, the promotion index value and initial index value for a given game play request are added together to produce a final index value. A table correlating potential final index values to various prizes is then used to identify a prize correlating to the final index value. In an alternate arrangement described below with reference to FIG. 5, both the promotion index value and the initial index value for a given game play request are separately correlated to prize values. In this arrangement, once both the initial index value and promotion index value have been determined, prize assignment involves identifying the prize correlating to the given initial index value, identifying the prize correlating to the promotion index value, and then assigning the sum of those prize values to the player.

The examples described below with reference to FIGS. 4 and 5 each use a random number arrangement for identifying a promotion index value for each game play request. However, any number of other arrangements may be employed to produce or generate the promotion index value. For example, the prize promotion controller may randomly or pseudo randomly identify some location along a scale and the scale could be correlated in some fashion to numeric designations, letter designations, or alphanumeric designations representing promotion index values. Although the random number arrangement described below with reference to the examples in FIGS. 4 and 5 is convenient for describing a preferred form of the present invention, the invention is by no means limited to this random number arrangement for producing the promotion index value.

The examples described below in FIGS. 4 and 5 also use purely numerical values for the various initial index values. However, the present invention is not limited to any particular arrangement for identifying and distinguishing between different index values. For example, index values may comprise letter codes or alphanumeric codes rather than the illustrated pure numeric codes.

Figure 4:
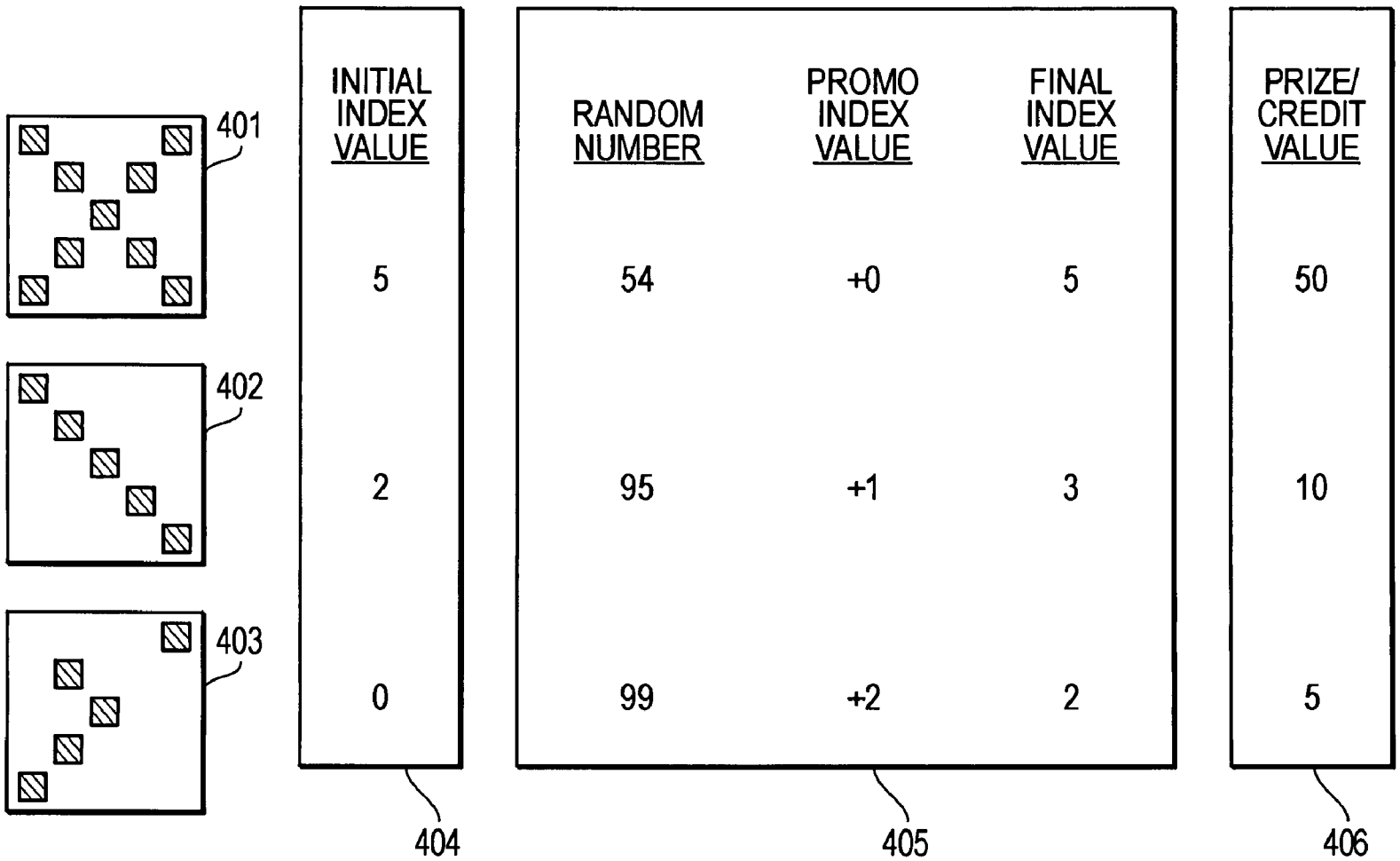
FIG. 4 is a diagram showing several examples of prize promotion according to the present invention.
Figure 5:
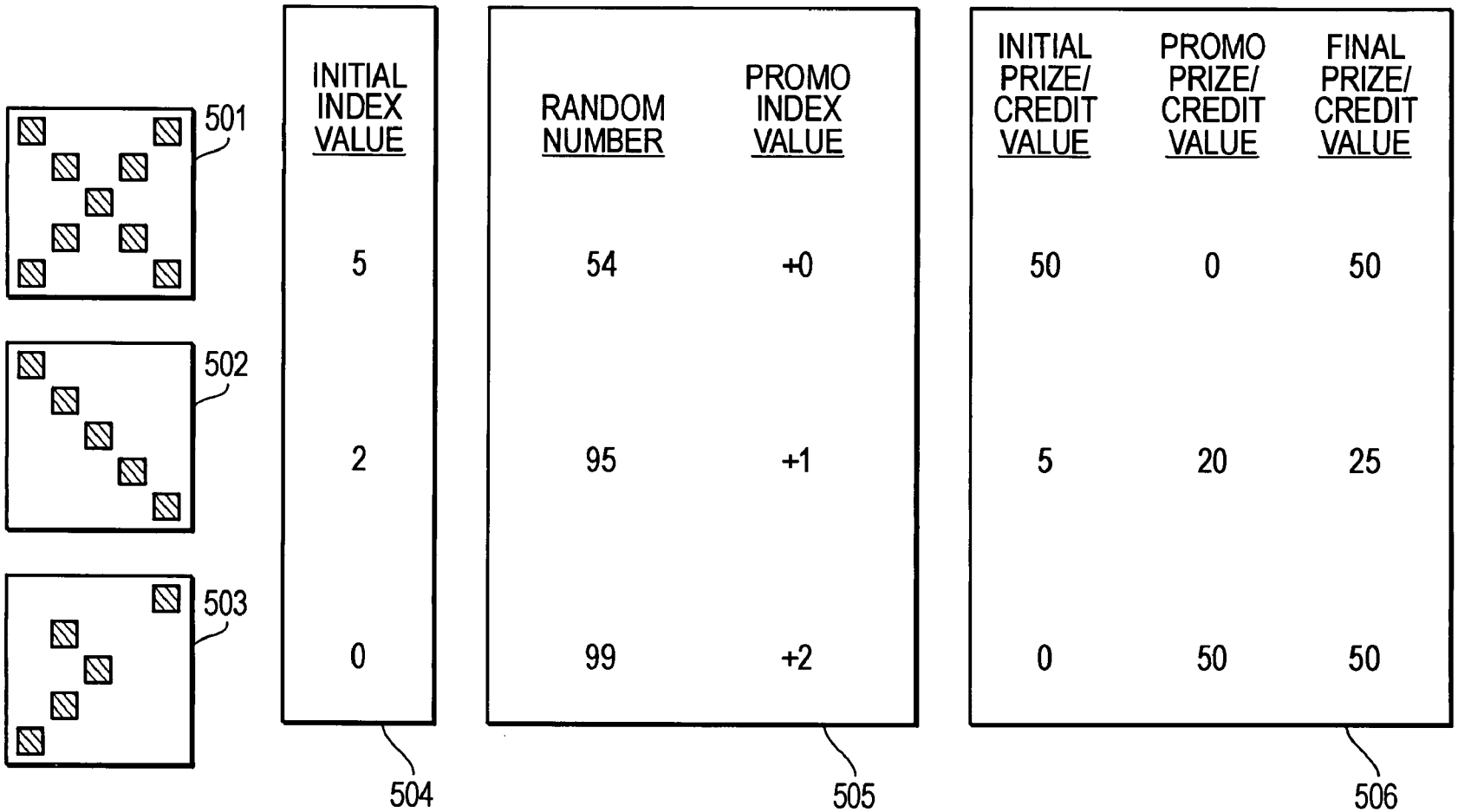
FIG. 5 is a diagram showing several examples of prize promotion according to an alternate embodiment of the present invention.

The following tables are useful in the examples shown in FIG. 4. In Table I, a number of index values are correlated with a prize/credit values.

TABLE I

| Index Value | Prize/Credit Value |
|---|---|
| 8 | 500 |
| 7 | 200 |
| 6 | 100 |
| 5 | 50 |
| 4 | 25 |
| 3 | 10 |
| 2 | 5 |
| 1 | 2 |
| 0 | 0 |

It will be appreciated that the invention is not limited to awarding prizes in terms of monetary value or credits. The prize/credit values shown in Table I are shown only as a convenient example for the purposes of describing the present invention. This particular example table includes nine different index values 0 through 8. Each of these index values correlates to a prize/credit value.

Table II correlates a number of different promotion index values each with a different random number range.

TABLE II

| Random Number Range | Promotion Index Value |
|---|---|
| 98-100 | +2 |
| 95-97 | +1 |
| 1-94 | 0 |

This particular table includes three different promotion index values +0, +1, and +2, each associated with a different random number range.

Referring now to FIG. 4, three different bingo cards are referenced at 401, 402, and 403. Each of these bingo cards is associated with a respective player in a bingo game and a respective bingo game play request. Also, each bingo card is shown as having matched a particular arrangement of card locations in a bingo game. The example bingo card 401 has achieved an "X" pattern whereas the example bingo card 402 has achieved a straight line diagonal pattern. Example bingo card 403 includes a number of matched locations, however these matched locations do not correspond to any prize-winning pattern in this example. As indicated by the column labeled "Initial Index Value" in FIG. 4, it is assumed for purposes of this example that the pattern achieved on card 401 correlates to an initial index value of 5, the straight line diagonal pattern achieved with bingo card 402 correlates to a initial index value of 2, and the non-winning pattern achieved with bingo card 403 correlates to an initial index value of 0. In a preferred form of the present invention, a bingo game result controller such as controller 204 shown in FIG. 2 has identified the patterns shown on bingo cards 401, 402, and 403 for a respective bingo game and has also identified the respective initial index value for each card. The prize/credit value correlating to each initial index value from Table I represents the prize the player would have won in the respective bingo game had the present invention not been employed.

According to the present invention, a promotion index value is produced for each respective bingo card 401, 402, and 403 shown in FIG. 4, and this promotion index value is applied to modify the prize assigned for the respective bingo card in the bingo game. In this example, a random number generator for generating a random number between 1 and 100 is used together with Table II to produce a promotion index value for each bingo card. In particular, a random number between 1 and 100 is generated and then the resulting number is used to identify the correlating promotion index value from Table II. In the illustrated example, it is assumed that the prize promotion controller or other element responsible for producing the promotion index values produces the random number "54" for bingo card 401, random number "95" bingo card 402, and random number "99" for bingo card 403. According to Table II, random number "54" correlates to a promotion index value of +0, random number "95" correlates to a promotion index value of +1, and random "99" correlates to a promotion index value of +2. By adding the initial index value with the promotion index value the final index value of 5 is ultimately produced for bingo card 401, final index value 3 is produced for bingo card 402, and final index value 2 is produced for bingo card 403. Referring back to Table I, final index value 5 for bingo card 401 correlates to the prize value 50, whereas final index value 3 for bingo card 402 correlates to the prize value 10, and final index value 2 for bingo card 403 correlates to the prize value 5.

The three examples shown in FIG. 4 readily illustrate how the present invention may be applied to modify the prize awarded to a bingo player in a bingo game. In the example for bingo card 401, the final index value on which the prize was based did not change from the initial index value. In contrast, the example bingo cards 402 and 403 both obtained a higher final prize index value than the initial index value. Thus, the players holding example bingo cards 402 and 403 were assigned a higher prize than they would have received without producing and applying the promotion index value. That is, the player submitting bingo card 402 in a bingo game would have received the prize/credit value of 5 just considering the initial index value based on the pattern achieved in the bingo game, but is assigned the prize/credit value 10 after applying the promotion index value. The player submitting card representation 403 would have received no prize/credit value considering only the initial index value based on the pattern achieved in the bingo game, but is assigned the prize/credit value 5 after applying the promotion index value.

It will be appreciated that the examples shown in FIG. 4 in light of Tables I and II are shown only for purposes of example and that the invention is not limited to these details. In particular, a pay table correlating index values to prize/credit values may be structured in any fashion suitable for a given game. Also, the invention is certainly not limited to the three-level random number/promotion index table shown in Table II. More or fewer promotion index levels may be defined within the scope of the invention. Also, some promotion index values may be negative in value so that the promotion index value has the effect of reducing the final index value with respect to the initial index value, and, thus, reduce the prize/credit value to be assigned to the player for submitting the respective card representation in a bingo game.

As discussed above with reference to FIG. 2, some preferred forms of the present invention perform the various processing tasks with several different processing devices or systems. In particular, identifying results in a bingo game such as the patterns shown on bingo cards 401, 402, and 403 and correlating those results with an initial index value are preferably performed with a bingo game result controller such as controller 204 shown in FIG. 2. Thus, the columns in FIG. 4 for the bingo cards 401 to 403 and initial index values are shown set off in a separate box 404. The steps associated with producing the promotion index value and final index value may be performed with a processing device such as prize promotion controller 202 shown in FIG. 2, and thus, the columns of FIG. 4 showing the generated random number, the promotion index value, and final index value is also shown set off in a separate box 405. Finally, the steps associated with correlating the final index value with the final prize/credit value to be assigned to a player is preferably performed with a processing device such as prize assignment controller 203 shown in FIG. 2. Thus, the prize/credit value column in FIG. 4 is shown set off in a separate box 406.

FIG. 5 may be used to describe an embodiment of the present invention in which a final index value is not assigned to the player in lieu of the initial index value. Rather, this embodiment of the invention assigns two different prize/credit values to a player, one prize/credit value associated with the initial index value and one prize/credit value associated with the promotion index value. These prize/credit values are combined to arrive at a final prize/credit value to be assigned to the player. The example shown FIG. 5 employs the same Table I above for correlating the initial index value to a prize value. This example also uses Table II above to identify a promotion index value for the respective player. However, the form of the invention illustrated in FIG. 5 also uses the following Table III to correlate each different promotion index value with a prize/credit value.

TABLE III

| Promotion Prize/ Credit Value | Promotion Index Value |
|---|---|
| 50 | +2 |
| 20 | +1 |
| 0 | 0 |

In this embodiment of the invention, the player is assigned a prize/credit value correlating to the initial index value and a separate prize/credit value correlating to the promotion index value.

FIG. 5 shows three bingo cards 501, 502, and 503 achieving the same three patterns shown in FIG. 4. As in the example described with reference to FIG. 4, the example illustrated in FIG. 5 assumes that the "X" pattern shown for bingo card 501 correlates to the initial index value of 5, the straight line diagonal pattern shown for bingo card 502 correlates to an initial index value of 2, and the non-winning pattern shown for bingo card 503 correlates to an initial index value of 0. FIG. 5 shows the same random numbers having been generated for identifying the promotion index values for the three card representations and, thus, shows the same promotion index values taken from Table II. However, in the embodiment of the invention illustrated in FIG. 5, the promotion index value is not added to the initial index value to obtain a final index value, and the final prize/credit value assigned to the player does not correlate with a final index value. Rather, the promotion index value correlates to a promotion prize/credit value and the prize assigned to the player comprises the sum of the prize/credit value correlating to the initial index value and the promotion prize/credit value. Thus, FIG. 5 includes a column entitled "Initial Prize/Credit Value" representing the value obtained from Table I for the respective initial index value for the respective bingo card, and a column entitled "Promo Prize/Credit Value" (promotion prize/credit value) representing the value obtained from Table m for the respective promotion index value. The final column of FIG. 5 shows the prize that is ultimately assigned to the respective player for their respective bingo card 501, 502, and 503, according to this embodiment of the invention. For bingo card 501, the prize assigned to the player is 50 credits, 50 credits correlated to the initial index value 50 from Table I plus 0 credits correlated to the promotion index value 0 from Table III. For bingo card 502, the final prize is 25 credits which is obtained by adding the prize/credit value 5 from Table I to the prize/credit value 20 from Table III. Finally, for the example bingo card 503, the final award is 50 credits representing the prize/credit value of 50 obtained for the promotion index value +2 from Table III plus the prize/credit value 0 for the initial index value 0 obtained from Table I.

As in FIG. 4, the various columns of FIG. 5 are separated into blocks according to processing elements in the system that preferably perform the associated processing. The "Initial Index Value" column is shown in block 504 to indicate that the bingo patterns and initial index value are preferably identified through a bingo game result controller such as controller 204 in FIG. 2. The "Random Number" and "Promo Index Value" columns are shown in block 505 to indicate that these values are preferably identified by a promotion controller such as controller 202 in FIG. 2. Finally, the last three columns in FIG. 5 are shown in block 506 to indicate that these values are preferably identified by a prize assignment controller such as controller 203 in FIG. 2.

It will be appreciated that the examples described above with reference to FIGS. 4 and 5 are merely examples of preferred implementations of the invention. Numerous variations on these examples are possible within the scope of the invention as defined in the accompanying claims. In particular, the various example table values are given purely for purposes of example and are not intended to represent values that could be used in actual games according to the present invention. Also, depending upon the implementation of the invention, an index value within the scope of the invention may represent a prize/credit value. In the examples shown in FIG. 5, bingo patterns may correlate directly with a prize value and thus the values shown as the initial index values may be replaced with the corresponding prize values. In the examples of both FIGS. 4 and 5, it was assumed that a random number was generated individually for each bingo card to identify the promotion index value to be applied. However, a single random number may be generated and applied to identify the promotion index value for more than one bingo card.

In particular, a bingo game may use the same random number and thus the same promotion index value for each bingo card in the game.

The present arrangement for modifying initial bingo game results may be combined with different game presentation procedures to help increase player enjoyment. For example, one preferred form of the present invention actually presents or discloses to the player the prize/credit award or at least a prize level indicator such as an index value corresponding to the initial bingo game result before applying prize promotion. Interesting graphic effects at a player station may then be employed to disclose to the player the final prize/credit value that is actually being assigned to the player according to the prize promotion/modification of the present invention.

In other variations within the scope of the invention, the prize promotion/modification may not be automatically performed for a given game play request. Rather, the player may be given the option of applying prize promotion/modification. The option may be given to the player at the time they make their game play request, or after an initial result is displayed, at both of these points, or at other points in the course of a bingo game.

As will become apparent to one of ordinary skill in the art and viewing the disclosed embodiments, further variations for prize promotion and generation are possible and are within the scope of the appended claims. The above described preferred embodiments are intended to illustrate the principles of the invention, but not to limit the scope of the invention. Various other embodiments and modifications to these preferred embodiments may be made by those skilled in the art without departing from the scope of the invention.

The invention claimed is:

1. A method including:

(a) Following a player initiated input at a player station, generating a game play request;

(b) identifying an initial index value for the game play request, the initial index value being correlated to a pattern achieved for the game play request in the bingo game;

(c) without any further inputs from the player other than one or more player inputs to generate the game play request for the player and identify the initial index value for the game play request, generating a random number, identifying a promotion index value for the game play request using the random number, the promotion index value being the applied to modify a bingo game prize for the game play request;

and (d) assigning to the player the bingo game prize for the game play request in the bingo game, wherein the bingo game prize is a credit value based in part on the initial index value and based in part on the promotion index value.

2. The method of claim 1 wherein identifying the promotion index value includes:

(a) identifying a random number range that includes the generated random number, the random number range being identified from a number of different random number ranges, with each different random number range being correlated to a respective promotion index value; and (b) selecting the respective promotion index value that is correlated to the identified random number range as the promotion index value identified for the game play request.

3. The method of claim 1 further including producing a final index value from the initial index value and the promotion index value, and wherein the bingo game prize assigned to the player for the game play request correlates to the final index value.

4. The method of claim 3 wherein producing the final index value from the initial index value and the promotion index value includes adding the promotion index value to the initial index value.

5. The method of claim 1 wherein the initial index value correlates to an initial prize value and the promotion index value correlates to a promotion prize value and the bingo game prize is the sum of the initial prize value and the promotion prize value.

6. The method of claim 1 further including receiving a prize claiming input for the player, receiving a daubing input for the player, or receiving both the prize claiming input and the daubing input for the player prior to identifying the initial index value for the game play request.

7. A method of assigning prizes for play in a bingo game in which a player makes one or more inputs at a player station to cause a game play request to be generated and to cause an initial index value to be identified for the game play request, the initial index value being associated with a pattern achieved in the conduct of the bingo game for the game play request, the method including:

(a) producing a promotion index value for the game play request by generating a random number and applying the random number to identify the promotion index value, the promotion index value being applied to modify a bingo game prize for the game play request, the promotion index value being different from the initial index value and being produced without any further inputs from the player other than one or more player inputs at the player station to cause the game play request to be generated and the initial index value to be identified for the game play request;

and (b) assigning to the player the bingo game prize for the player's participation in the bingo game, wherein the bingo game prize is a credit value based in part on the promotion index value and based in part on the initial index value.

8. A program product stored on at least one non-transitory storage medium, the program product including a set of machine-readable instructions that when executed are configured to:

(a) identify an initial index value for a game play request which has been generated for a player in a bingo game, the initial index value being correlated to a pattern achieved for the game play request in the bingo game;

(b) without any further inputs from the player other than one or more player inputs to generate the game play request for the player and identify the initial index value for the game play request, generate a random number and identify a promotion index value for the game play request using the random number, the promotion index value being applied to modify a bingo game prize for the game play request;

and (c) assign to the player the bingo game prize for the game play request in the bingo game, wherein the bingo game prize is a credit value based in part on the initial index value and based in part on the promotion index value.

9. The program product of claim 8 wherein the machine-readable instructions are configured to:

(a) identify a random number range that includes the generated random number, the random number range being identified from a number of different random number ranges, with each different random number range being correlated to a respective promotion index value; and (b) select the respective promotion index value that is correlated to the identified random number range as the promotion index value identified for the game play request.

10. The program product of claim 8 further including machine-readable instructions that, when executed, are configured to produce a final index value from the initial index value and the promotion index value, and wherein the bingo game prize assigned to the player correlates to the final index value.

11. The program product of claim 10 wherein the machine-readable instructions are executable to add the promotion index value to the initial index value to produce the final index value.

12. The program product of claim 8 wherein the initial index value correlates to an initial prize value and the promotion index value correlates to a promotion prize value, and wherein the machine-readable instructions are executable to add the initial prize value and the promotion prize value to produce the bingo game prize.

13. The program product of claim 8 wherein the machine-readable instructions are executable to identify the initial index value for the game play request after a prize claiming input for the player, after a daubing input for the player, or after both the prize claiming input and the daubing input for the player.

14. A system including:

(a) a bingo game result controller for identifying a bingo game result for a respective game play request in a bingo game, the bingo game result being correlated to an initial index value;

(b) a prize promotion controller for determining a promotion index value for the bingo game result, the promotion index value being applied to modify a bingo game prize based for the game play request, the promotion index value for the bingo game result being determined without any further inputs from a player other than one or more player inputs to generate the game play request for the player and identify the bingo game result for the respective game play request;

(c) a prize assignment controller for receiving the promotion index value and the initial index value, and for assigning the bingo game prize for the respective bingo game result, wherein the bingo game prize is a credit value based in part on the promotion index value and based in part on the initial index value;

and (d) a random number generator for generating a random number which is applied by the prize promotion controller to determine the promotion index value.

15. The system of claim 14 wherein the bingo game result controller, the prize promotion controller, and the prize assignment controller are each implemented with a processing device remote from a player station.

16. The system of claim 14 wherein the prize promotion controller is also for producing a final index value by combining the initial index value and the promotion index value.

17. The system of claim 14 wherein the bingo game result controller requires a prize claiming input for the player, a daubing input for the player, or both the prize claiming input and the daubing input for the player prior to identifying the initial index value for the game play request.

* * * * *

UNITED STATES PATENT AND TRADEMARK OFFICE

CERTIFICATE OF CORRECTION

PATENT NO. : 7,806,762 B2
APPLICATION NO. : 11/076257
DATED : October 5, 2010
INVENTOR(S) : John E. Padgett It is certified that error appears in the above-identified patent and that said Letters Patent is hereby corrected as shown below:

At column 6, line 1: change “shown at blcok” to read --shown at block--.

At column 6, line 34: change “at process blcok” to read --at process block--.

At column 10, line 19: change “from Table m” to read --from Table III--.

Signed and Sealed this
Fifteenth Day of March, 2011

David J. Kappos

David J. Kappos
*Director of the United States Patent and Trademark Office*